United States Patent [19]

Haenni et al.

[11] 4,106,323

[45] Aug. 15, 1978

[54] BENDING TOOL

[75] Inventors: Eduard J. Haenni, Zofingen; Vaclav Zbornik, Oftringen, both of Switzerland

[73] Assignee: Haennerle AG, Zofingen, Switzerland

[21] Appl. No.: 698,007

[22] Filed: Jun. 21, 1976

[30] Foreign Application Priority Data

| | | | |
|---|---|---|---|
| Jun. 24, 1975 | [AT] | Austria | 4849/75 |
| Oct. 13, 1975 | [AT] | Austria | 7808/75 |
| Apr. 2, 1976 | [AT] | Austria | 2404/76 |

[51] Int. Cl.[2] ..... B21D 7/06

[52] U.S. Cl. ..... 72/389; 72/448

[58] Field of Search ..... 72/389, 385, 386, 448, 72/447, 473

[56] References Cited

U.S. PATENT DOCUMENTS

| | | | |
|---|---|---|---|
| 391,408 | 10/1888 | Fitzberger | 72/321 |
| 2,199,864 | 5/1940 | Wehr | 72/448 |
| 2,456,856 | 12/1948 | Bath | 72/462 |
| 2,826,947 | 3/1958 | Creek | 72/448 |
| 3,844,156 | 10/1974 | Hanni | 72/389 |
| 3,965,721 | 6/1976 | Roch | 72/448 |
| 3,978,706 | 9/1976 | Nakagawa | 72/389 |

FOREIGN PATENT DOCUMENTS

| | | | |
|---|---|---|---|
| 1,085,487 | 7/1960 | Fed. Rep. of Germany | 72/389 |

*Primary Examiner*—C.W. Lanham
*Assistant Examiner*—Gene P. Crosby

[57] ABSTRACT

A bending device comprising a bar for connection at one end to a ram of a bending press, the bar having a tapered end fitting into a bending matrix fitted with a displaceable jaw. A sheet of metal placed on the matrix is bent by the bar which is forced down by the ram into a longitudinal groove of the matrix. Means are provided at the side of the matrix to determine the limiting plane of the groove and thereby control the angle and further means vary the depth of the groove.

5 Claims, 8 Drawing Figures

BENDING TOOL

BACKGROUND OF THE INVENTION

1. Field of the Invention

The present invention relates to a bending tool for the bending of sheet-metal comprising a bending bar connected to a ram of the bending press and a corresponding bending matrix including a portion into which the bar is pressed against a sheet metal workpiece by said ram. The bending matrix is provided with a longitudinal groove running along the matrix on the side facing the bending bar, This groove determines by its shape, i.e. by its width and depth, the angle of bending imparted by the bar when it is forced into the groove of the matrix.

2. The Prior Art

Bending tools are known in the prior art and are very suitable for the bending of sheet metal and have proved to be very useful. Yet there is a disadvantage which lies in the fact that for each occasion in which a change in the angle of bending the matrix also has to be exchanged.

OBJECT OF THE INVENTION

It is the aim of the present invention to propose an essentially improved type of such a bending tool which new type comprises a matrix that can be adjusted to achieve a desired bending angle, by the adjustment of the matrix-opening the thickness of the sheet-metal, too, being taken into account.

SUMMARY OF THE INVENTION

The bending tool for the bending of sheet-metal comprises a bending bar and a corresponding bending matrix which bending matrix is provided with a groove running along the matrix on the side facing the bending bar and determining the bending-angle by its width and depth. According to the invention, it is proposed that at least one of the planes limiting the groove can be variably positioned relatively to the other planes. Thereby it is practical to provide adjustment bodies which are arranged on the bottom of the groove and by which the depth of the groove can be adjusted. Another possibility consists in the application of a matrix with adjustable jaws so that at least one of the side faces of the matrix can be variably adjusted in its position relativ to the other side face.

Further, it proves to be advantageous to provide vertical openings at the bottom of the groove, in which openings support members are freely displaceable which support members rest on their lower end on the surface of a support body by which the relative position of the support members in the matrix can be changed.

BRIEF DESCRIPTION OF THE DRAWING

In the following, there will be described some embodiments of the invention, with reference to the accompanying drawings, in which.

DESCRIPTION OF THE PREFERRED EMBODIMENT

Figure 1A:
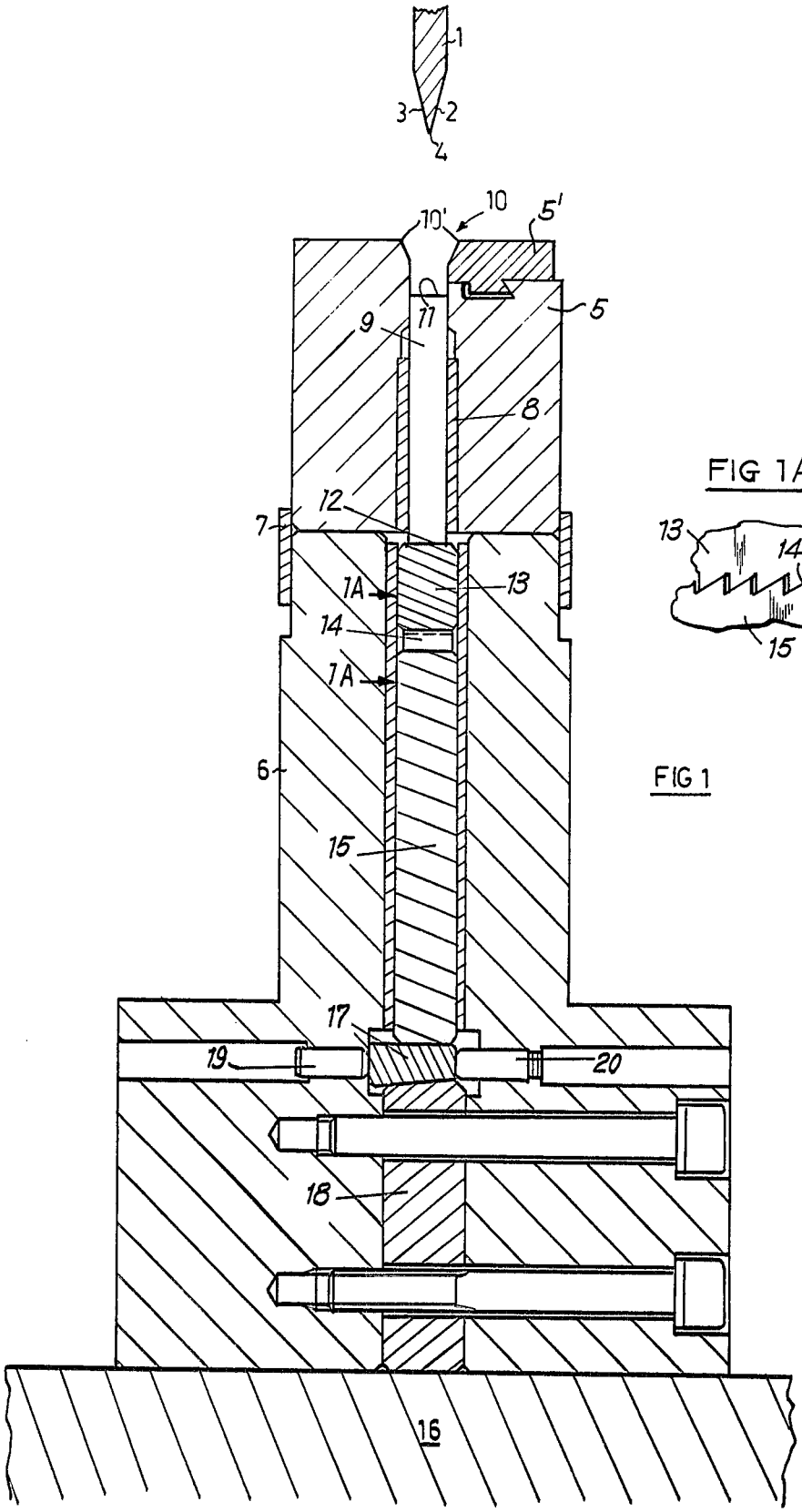
FIG. 1A is a fragmentary side elevational view, taken on the section line 1A—1A of FIG. 1 showing the chamfered saw tooth arrangement of the guide bar and guide member.
Figure 1:
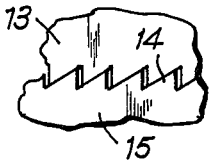
FIG. 1 shows a vertical corss-section through a first type of bending tool.

The bending tool of FIG. 1 comprises a bending bar 1, fastened to the ram of a bending press not shown in the drawing. The two tapered working areas 2 and 3 of the bending bar meet at the working edge 4 under an angle which is smaller than the minimum bending angle which is to be achieved in the workpiece consisting of a piece of sheet metal. The bending bar 1 interacts with a bending matrix 5 which is fastened on a support 6 by means of connecting pieces 7. The matrix is provided with a longitudinal running groove 10 on the surface facing the bending bar 1. This groove determines the bending angle by the relative position of two opposed tapered edges 10' limiting the sides of the groove and by the depth of the groove. The matrix 5 is furthermore provided with a jaw 5' which is displaceable sideways, as it will be later described.

The flat groove 10 is arranged in the middle of the matrix 5 and lies in a vertical plane. The bottom of the groove is provided with several vertical openings 8, shown in FIG. 1 as circular bores, in which openings freely displaceable pins 9 are arranged serving as supports. The upper faces 11 of said pins 9 form the bottom of the groove which interacts with the tapered working edge 4 of the bending bar 1. The opposite or lower faces of the pins 9 rest on the surface 12 of a guide bar 13. This guide bar 14 has a chamfered or saw-toothed lower face which fits to the upper face of a gliding member 15 by which it is supported. The guide bar 13 and the gliding member 15 are guided by a support 6 consisting of two pieces which theirselves are fastened on the work bench 16 of the bending machine. Furthermore, means for the displacement of the gliding member 15 are provided which are of known type and which will not be further described. The displacement of the gliding member causes a variation in height of the guide bar 13. In this manner the position of the upper faces 11 of the pins 9 in the groove 10, and thereby the depth of the groove, is varied. At the same time, the jaw 5 can be displaced, so that the desired bending angle can be accurately adjusted.

It proves to be necessary, that the long gliding member 15 can be very accurately adjusted. Local deviations cannot always be corrected by a simple displacement of the gliding member. Furthermore, by the use and wear of the tools inaccuracies can occur, making local corrections on the gliding member indispensable. For this reason, wedge-shaped members 17 are arranged below and cross to the gliding member 15 which are supported by a solid common body 18 and which can be individually adjusted. Positioning screws 19, 20, are provided, one screw 19 and one screw 20 for every wedge-shaped member.

A displacement of the gliding member 15 causes a lowering or raising of the guide-bar 13 which raising or lowering itself causes a displacement of the pins 9 in the bores 8 in axial direction. In the same way, the distance of the upper face 11 of the pins from the matrix surface is changed. This distance as well as the position of the jaw 5' determines the bending angle to be achieved in the sheet-metal, caused by the action of the bending bar 1. In order that this angle does not vary along the entire length of the guide bar 13, a local correction can be achieved by means of an adjustment of one or more of the members 17.

Figure 2:
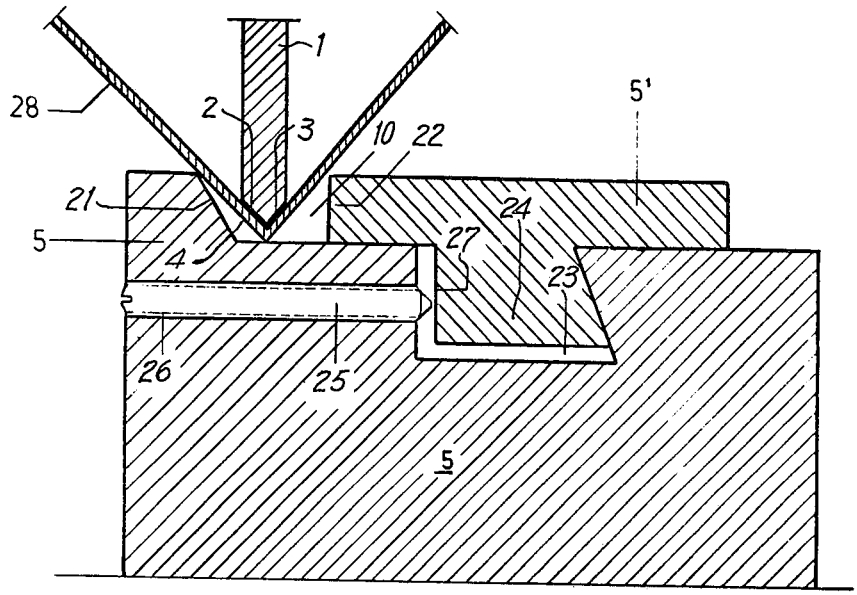
FIG. 2 shows a schematical diagramm of the adjustment facilities in a cross-sentional view.
Figure 3:
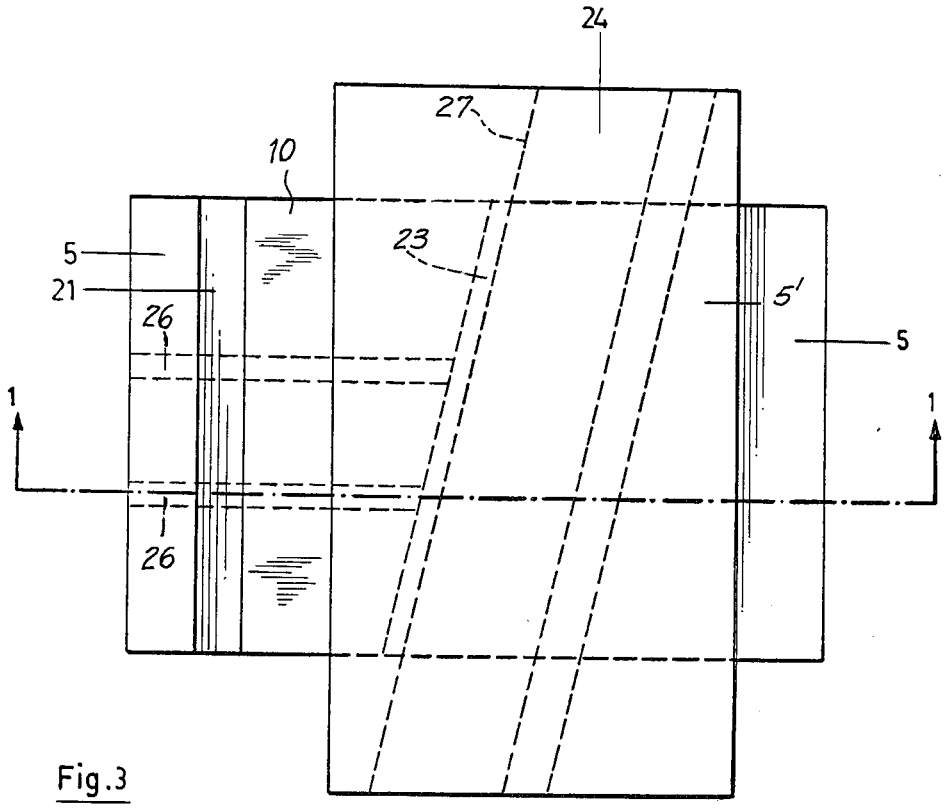
FIG. 3 shows the same as FIG. 2 in a top view.

The adjustment of the jaw 5' is shown more explicitely in FIGS. 2 and 3 in an elarged schematical drawing.

The matrix 5 which interacts with the bending bar 1 is again supported by a support not shown in the drawing. On the surface of the matrix 5 facing the bending bar 1 the longitudinally running groove 10 is arranged which is limited on one side face by the matrix and on the other side by the side face 22 of the displaceable jaw 5'. The jaw 5' is displaceable in a guiding 23 of the matrix 5, so that by the displacement of the jaw 5' the opening in the matrix by the groove 10 is enlarged or diminished. For this reason, the guiding 23 in the matrix 5 is not running parallel, but at a certain angle to the groove, as it can be seen from FIG. 3. The guiding 23 is of trapezoidal or quasi-trapezoidal cross-section and holds the guide bar 24 of the jaw 5'. This guide bar 24 is provided on the lower side of the jaw 5' which does not face the bending bar 1 and runs parallel to the guiding 23.

Fastening screws 25 are provided in threaded bores 26 in the matrix 5 which lie cross to the guiding 23 and at a regular distance from one another. The fastening screws 25 can be screwed into the guiding 23, thereby passing on the side face 27 of the guide bar 24.

By means of these fastening screws, the jaw 5' can be fixed in its position and is secured against involuntary displacement in the guiding 23.

For the displacement of the jaw 5', a very accurate screwed spindle can be provided, again not shown in the drawing, which allows for a very accurate positioning of the jaw.

An an alternative to the described guiding, the jaw 5' could be provided with a toothed bottom face, enabling thus a direct positioning of the jaw 5'.

In the described way, the opening in the matrix of the bending machine can be easily changed and adjusted to the thickness of the sheet metal to be processed. It also would be possible that not only one but both side faces of the matrix could be adjusted. In this case, the bottom of the groove 10 would again have to be provided with bores for the pins, as previously described.

Further possibilities for the adjustment of the pins can be seen in FIGS. 4 to 7.

Figure 4:
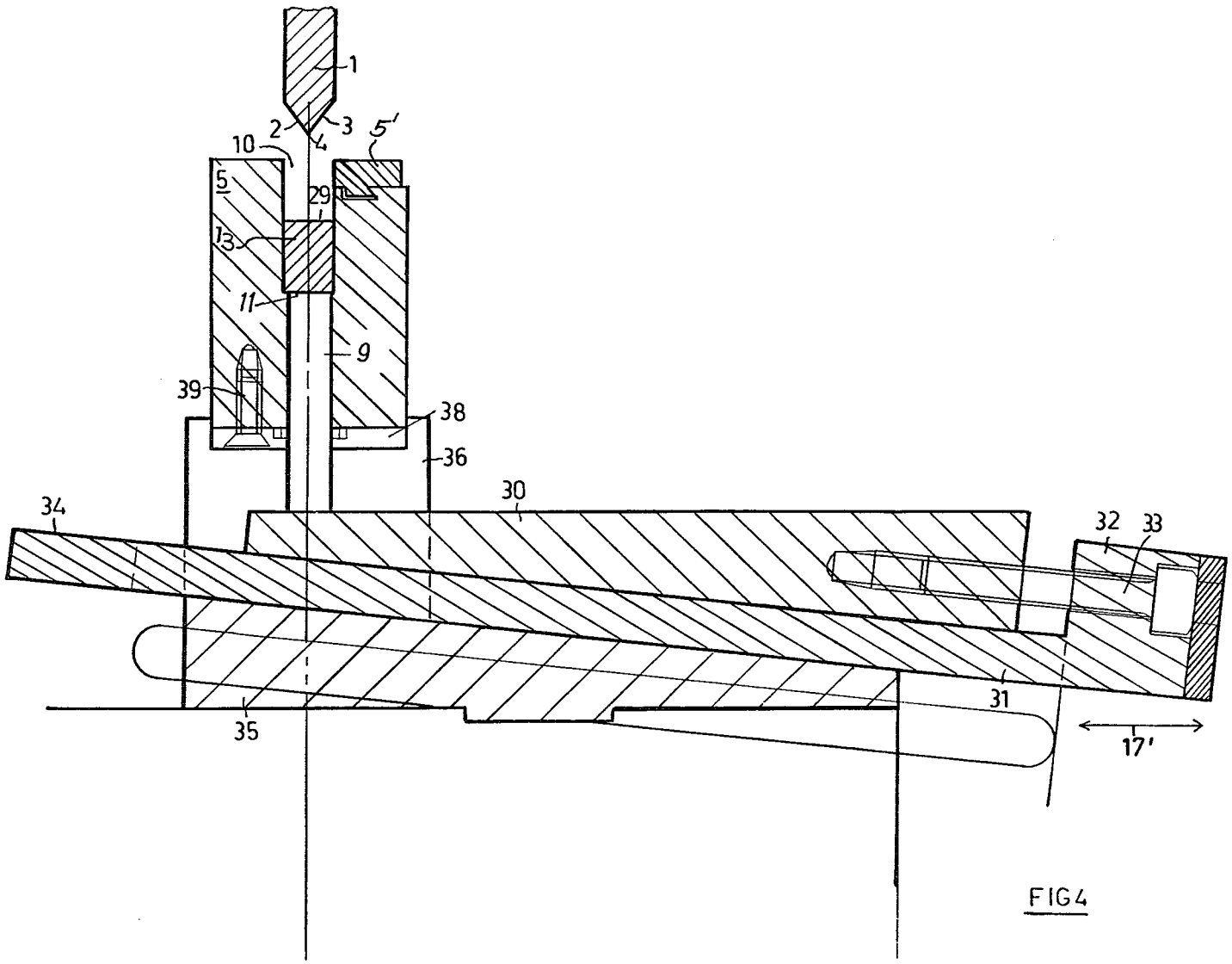
FIG. 4 shows another type of bending tool in a vertical cross-section.
Figure 5:
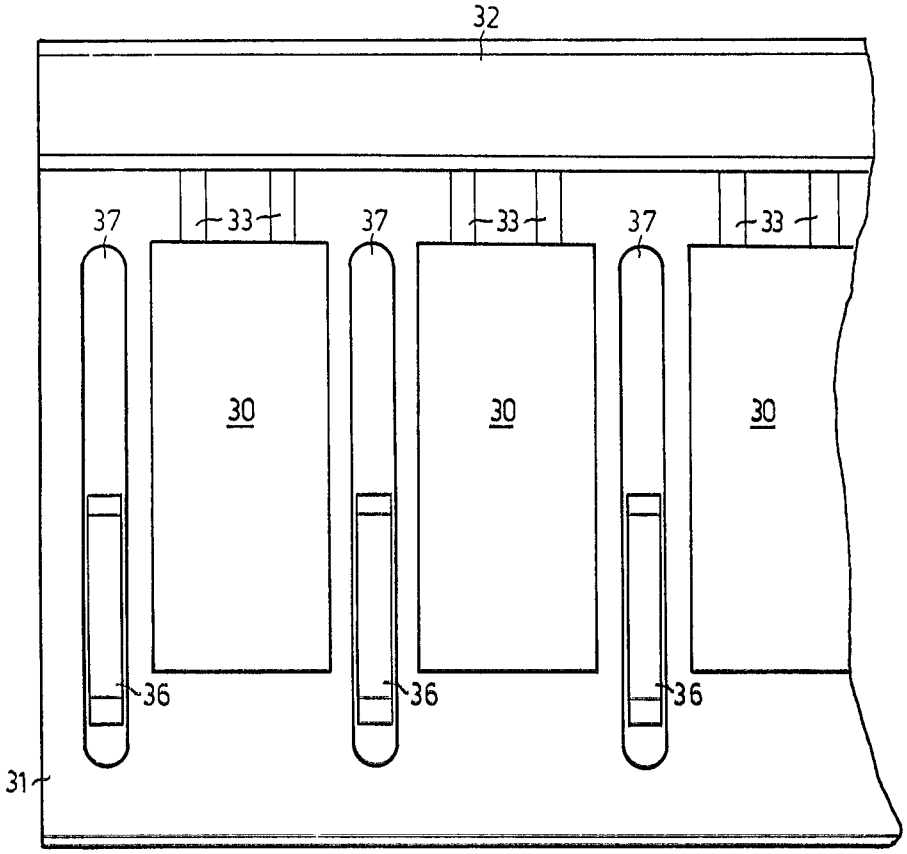
FIG. 5 is the top view of FIG. 4.

The bending machine in FIG. 4 is similarly constructed as the one of FIG. 1. Identical parts are designed with the same numbers.

The front faces of the pins 9 form a support for a bar 13 which bar is made out of one or several parts. The surface 19 of said bar interacts with the working edge 4 of the bending bar 1. The opposite sides of the pins rest each on a surface of a sliding wedge 30. The sliding wedges 30 are supported by a common oblique plate 31 which plate is provided with a terminating bar on its lower lying side provided with adjustment screws 33 extending into the sliding wedges.

Each sliding wedge 30 can therefore be individually adjusted in its position relative to the plate 31 by means of the respective adjustment screw.

The oblique plate 31 is fixed on a base support and is displaceable in the direction of the arrow 17'. The means for the displacement are not explicitely shown in the drawing. These means can be of ordinary type, for instance, they could consist of a toothed bar which is driven pneumatically or hydraulically, or they could consist of a threaded spindle or similar means. The displacement of the plate 31 causes a displacement of the sliding wedges 30, and the pins 9 are therefore displaced in vertical direction, so that the position of the bar 13 in the groove 10 is changed. Thus, a variation of the depth of the groove 10 is achieved.

The matrix 5 is supported by support members 36 which extend from the base support through slits 37 in the oblique plate 31. Each support member 36 is provided with a groove in which the matrix 5 is inserted. The matrix 5 is provided with a lower cover plate 38 which is fastened by the screws 39.

In the described arrangement, the adjustment of the bending angle is achieved by a lowering of raising or the pins 9. To raise or lower the pins the oblique plate 31 is displaced together with the sliding wedges 30 in the direction of the arrow 17', whereby the sliding wedges do not alter their relative position.

For local corrections of the position of the pins of the matrix 5, the pins can be individually adjusted by an alteration of the position of the respective sliding wedge. This correction in the position of a specific sliding wedge can be very accurately done by turning the respective adjustment screw 33. In this manner, local variations, over-stress etc. can easily be compensated.

It should be noted, that instead of the bar 13, the pins 9 could be equipped with cylindrical heads, which according to the position of the pins would lie more or less deeply inside the groove. This arrangement would also allow for a very accurate adjustment of the bending angle.

Figure 6:
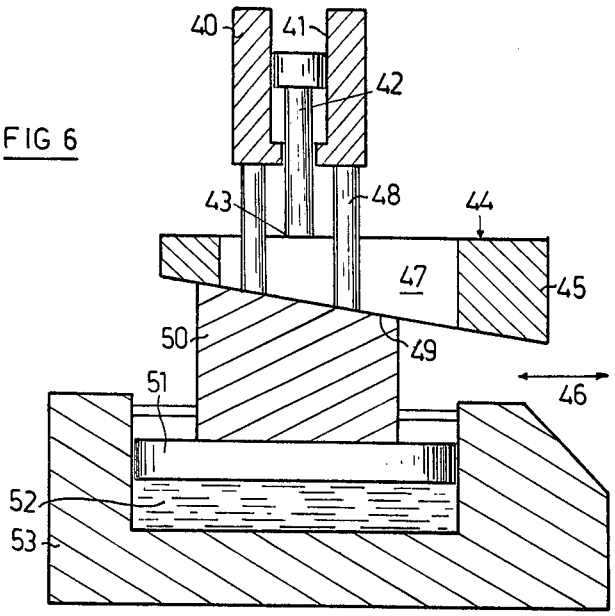
FIG. 6 shows a first variant of FIG. 4 in a vertical cross-section.

Another variant of this arrangement can be seen in FIG. 6, which shows a matrix 40 with a groove 41 and with displaceable pins 42, the arrangement of which being similar to that of the pins 9 in FIG. 4. The lower faces of the pins are supported on the surface of a wedge 45 which is displaceable in the direction of the arrow 46 by means not explicitely shown. Instead of only one wedge, a number of wedges can be provided, connected by a common head bar and individually adjustable. The wedge is provided with slits 47, through which bolts 48 for the supporting of the matrix 40 extend. The wedge 45 is supported on the oblique surface 49 of a support 50 which is provided with a number of piston-like extensions 51. These extensions are displaceable in cylindrical bores 52 of the base support 53. Under each extension an oil cushion is provided. This kind of support prevents, resp. compensates an eventual sag of the matrix in the case of uneven load.

Figure 7:
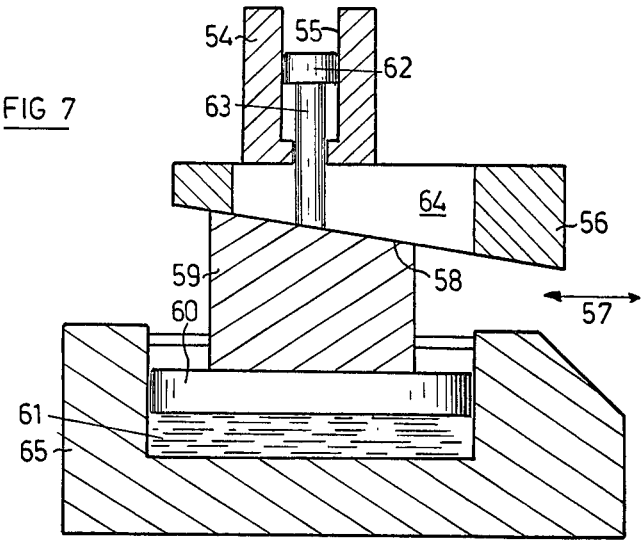
FIG. 7 shows yet another variant in a vertical cross-section.

A further variant, where the matrix is displaceable and the bottom of the groove remains fixed in its position is shown in FIG. 7. The matrix 54 is provided with a groove 55 and is supported by a passing wedge 56 which is displaceable in the direction of the arrow 57. The wedge 56 is supported on an oblique surface of a support 59, which support 59 again is equipped with piston-like extensions 60, which extend into oil-filled cylindrical bores 61 in the base support 65.

The bottom of the groove is provided with bores which guide the pins 63, provided with heads 62. Corresponding to each one of these pins, a slit 64 in the wedge 56 is provided, through which slits the pins extend, being supported by the oblique surface 58 of the support 59.

A displacement of the wedge 56 causes a raising or lowering of the matrix, while the pins 63 remain in their position. The length of the slits is somewhat larger than the maximal displacement of the wedge. Local inaccuracies and overstresses are compensated by the oil-cushion, so that an additional fine-adjustment of the wedges is not necessary.

The described bending tool allows an accurate and fast processing and makes possible a sequence of bending processes with different bending angles without the need of changing the matrix.

We claim:

1. A bending device adapted to be connected to a bending press for the bending of sheet metal in said press, comprising in combination:

a male bending die adapted to be connected to the ram of the bending press with a tapered end, and a female bending die resting on a die support, said female die having a longitudinal groove on its top side facing said male die and cooperating with said tapered end of said male die;

said longitudinal groove determining by its width and depth the bending angle to be achieved in the sheet metal workpiece fitted between said male die and female die whereby at least one of the limiting planes of the groove is displaceable in its position relative to the other limiting planes of the groove to change the shape of the groove and thereby the angle to be bent in the sheet metal;

a displaceable jaw on said female die to change the width of said groove, said jaw having a first guide means protruding from said displaceable jaw and engaging a first guide notch in the base part of said female die, said first guide means and said first guide notch extending in an angle to said groove, the width of said groove thereby changing by sliding said first guide means along said first guide notch, and a displaceable support means to change the depth of said groove, said support means resting on a second guide means arranged in a second guide notch in said die support of said female die, a displacement of said second guide means varying the depth of said groove.

2. A bending tool as claimed in claim 1 wherein said female die is provided with clamping screws which are located cross wise to said first guide notch, extend at their ends into said first guide notch, and are spaced a predetermined distance apart from each other to thereby permit clamping of the guide relative to the guide notch.

3. A bending tool as claimed in claim 1 wherein said female die is provided with a base at the bottom thereof, vertical cylindrical openings extending from said base reaching to said groove and freely displaceable pin members in said openings which serve as adjustable support means and rest at their lower ends on said second guide means, the upper ends of said pins serving to define the supporting surface of said longitudinal groove.

4. A bending tool as claimed in claim 3 wherein said second guide means comprises a displaceable guide bar and a displaceable guiding members supporting said guide bar, said pins being supported at their bottom ends on said guide bar and said guide bar having a chambered lower face which fits against the upper face of said guiding member whereby the displacement of said guiding member provides a variation in height of said press.

5. A bending tool as claimed in claim 4 wherein the bending machine is provided with a working bench, and said guide bar and gliding member are fixed to said working bench of the bending machine by means of two supports.

* * * * *